US007500652B2

(12) United States Patent
Kawakami et al.

(10) Patent No.: US 7,500,652 B2
(45) Date of Patent: Mar. 10, 2009

(54) HOIST FOR ELEVATOR

(75) Inventors: Shigenobu Kawakami, Tokyo (JP); Takayuki Shimizu, Tokyo (JP); Shun-Ichirou Saitou, Tokyo (JP)

(73) Assignees: Mitsubishi Electric Corporation, Tokyo (JP); Mitsubishi Electric Building Techno-Service Co., Ltd, Tokyo (JP)

( * ) Notice: Subject to any disclaimer, the term of this patent is extended or adjusted under 35 U.S.C. 154(b) by 90 days.

(21) Appl. No.: 11/571,936

(22) PCT Filed: Dec. 1, 2004

(86) PCT No.: PCT/JP2004/017858

§ 371 (c)(1),
(2), (4) Date: Feb. 26, 2007

(87) PCT Pub. No.: WO2006/059380

PCT Pub. Date: Jun. 8, 2006

(65) Prior Publication Data

US 2007/0235703 A1 Oct. 11, 2007

(51) Int. Cl.
*B66D 1/36* (2006.01)

(52) U.S. Cl. ..... 254/334; 254/266

(58) Field of Classification Search ..... 254/334, 254/266, 278, 362, 365, 368
See application file for complete search history.

(56) References Cited

U.S. PATENT DOCUMENTS 4,013,142 A * 3/1977 Hagg ..... 187/254
4,526,252 A * 7/1985 Hirano ..... 187/254
6,601,828 B2 * 8/2003 Strbuncelj et al. ..... 254/266

FOREIGN PATENT DOCUMENTS

JP 61 15281 1/1986
JP 63 139276 9/1988
JP 02 282179 11/1990
JP 2000063063 A * 2/2000
JP 2001-278560 10/2001
JP 2001 278560 10/2001

* cited by examiner

*Primary Examiner*—Emmanuel M Marcelo
(74) *Attorney, Agent, or Firm*—Oblon, Spivak, McClelland, Maier & Neustadt, P.C.

(57) ABSTRACT

A hoisting machine for an elevator includes a motor having a motor body and a rotary shaft rotatable with respect to the motor body and a boss, which is a handle fit/removal member and is fixed to the rotary shaft. A manually operated handle for manually rotating the rotary shaft can be removably fitted on the boss. The boss is provided with a rotation prevention portion for preventing, when the manually operated handle is fixed to the boss, the manually operated handle from rotating with respect to the boss in a rotational direction of the rotary shaft.

4 Claims, 4 Drawing Sheets

HOIST FOR ELEVATOR

TECHNICAL FIELD

The present invention relates to an elevator for raising/lowering a car and a counterweight.

BACKGROUND ART

In a conventional hoisting machine for an elevator, a manually operated handle for moving a car with the aid of man power when the car has stopped between floors due to, for example, a blackout or a breakdown may be mounted on an end of a rotary shaft of a motor in some cases. When an operator mounts the manually operated handle on the rotary shaft of the motor and then manually turns the manually operated handle thus mounted, the car can thereby be moved to the nearer one of the floors (see Patent Document 1).

Patent Document 1: JP 2001-278560 A

DISCLOSURE OF THE INVENTION

Problems to be Solved by the Invention

In the conventional hoisting machine constructed as described above, however, the manually operated handle is directly mounted on the rotary shaft. Therefore, a plurality of manually operated handles of different kinds may be required for a plurality of hoisting machines having rotary shafts with different axial diameters. Accordingly, it is costly to manufacture the plurality of the manually operated handles of the different kinds, and it is also laborious to select that one of the manually operated handles which fits to the axial diameter of each of the rotary shafts.

The present invention has been made to solve the above-mentioned problems, and it is therefore an object of the present invention to obtain an elevator, which makes it possible to reduce the manufacturing cost of a manually operated handle mounted on a rotary shaft of a motor and reduce the amount of labor in moving a car by means of the manually operated handle.

Means for Solving the Problems

An elevator according to the present invention includes: at least one of a plurality of hoisting machines having motors having rotary shafts, and handle fit/removal members fixed to the rotary shafts in rotational directions of the rotary shafts, respectively. The handle fit/removal members are each provided with a rotation preventing portion that can be removably fitted with a common manually operated handle for manually rotating each of the rotary shafts, for preventing the manually operated handle from rotating with respect to each of the handle fit/removal members in the rotational direction of a corresponding one of the rotary shafts when the manually operated handle is fitted on that one of the handle fit/removal members.

BEST MODES FOR CARRYING OUT THE INVENTION

Preferred embodiments of the present invention will be described hereinafter with reference to the drawings.

Embodiment 1

Figure 1:
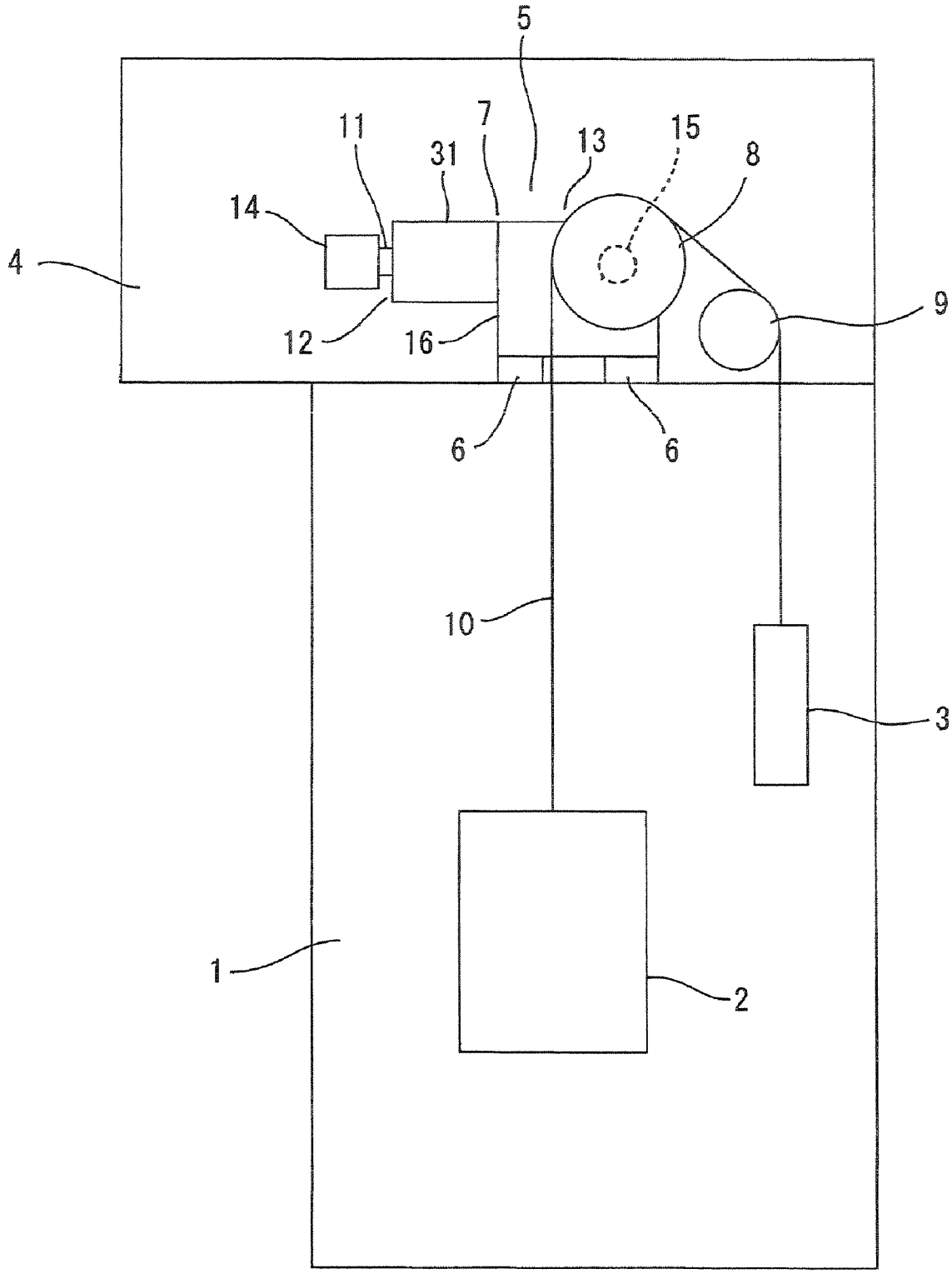
FIG. 1 is a schematic diagram showing an elevator according to Embodiment 1 of the present invention.

FIG. 1 is a schematic diagram showing an elevator according to Embodiment 1 of the present invention. In the figure, a car 2 and a counterweight 3 are provided so as to be capable of being raised/lowered within a hoistway 1. A machine room 4 is provided above the hoistway 1. A hoisting machine 5 as a driving machine for generating a driving force for raising/lowering the car 2 and the counterweight 3 is installed within the machine room 4. The hoisting machine 5 is supported on a support member 6 provided within the machine room 4.

The hoisting machine 5 has a hoisting machine body (driving machine body) 7, and a drive sheave 8 rotated by the hoisting machine body 7. A deflector sheave 9, which is disposed apart from the drive sheave 8, is provided within the machine room 4.

A plurality of main ropes 10 are looped around the drive sheave 8 and the deflector sheave 9. The car 2 and the counterweight 3 are suspended within the hoistway 1 by means of the respective main ropes 10. The car 2 and the counterweight 3 are raised/lowered within the hoistway 1 through rotation of the drive sheave 8.

The hoisting machine body 7 has a motor 12 including a motor body 31 and a motor shaft (rotary shaft) 11 rotatable with respect to the motor body 31, a reduction gear 13 mounted with the motor 12 to transmit the rotational force of the motor shaft 11 to the drive sheave 8, and a motor shaft device 14 provided on an end of the motor shaft 11 to be rotatable together with the motor shaft 11.

The reduction gear 13 has a horizontally extending main shaft 15, and a reduction gear body 16 for decelerating rotation of the motor shaft 11 and transmitting the rotation to the main shaft 15. The main shaft 15 is rotated when rotation of the motor shaft 11 is decelerated and transmitted to the main shaft 15. The drive sheave 8 is fixed to the main shaft 15. Accordingly, the drive sheave 8 receives its rotational force from the motor shaft 11 via the reduction gear 13 to thereby be rotated integrally with the main shaft 15.

Figure 2:
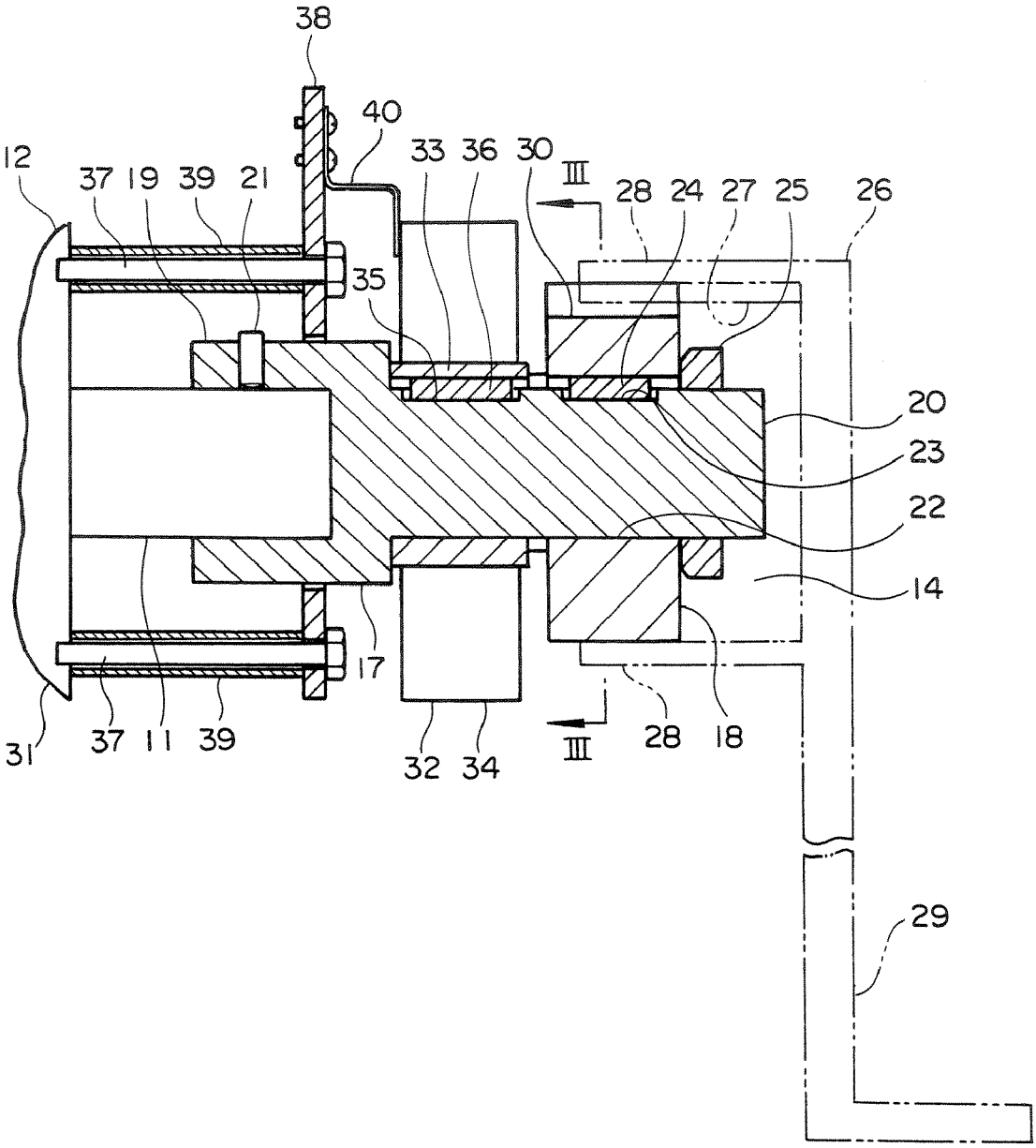
FIG. 2 is a cross-sectional view showing an essential part of the motor shaft device of FIG. 1.
Figure 3:
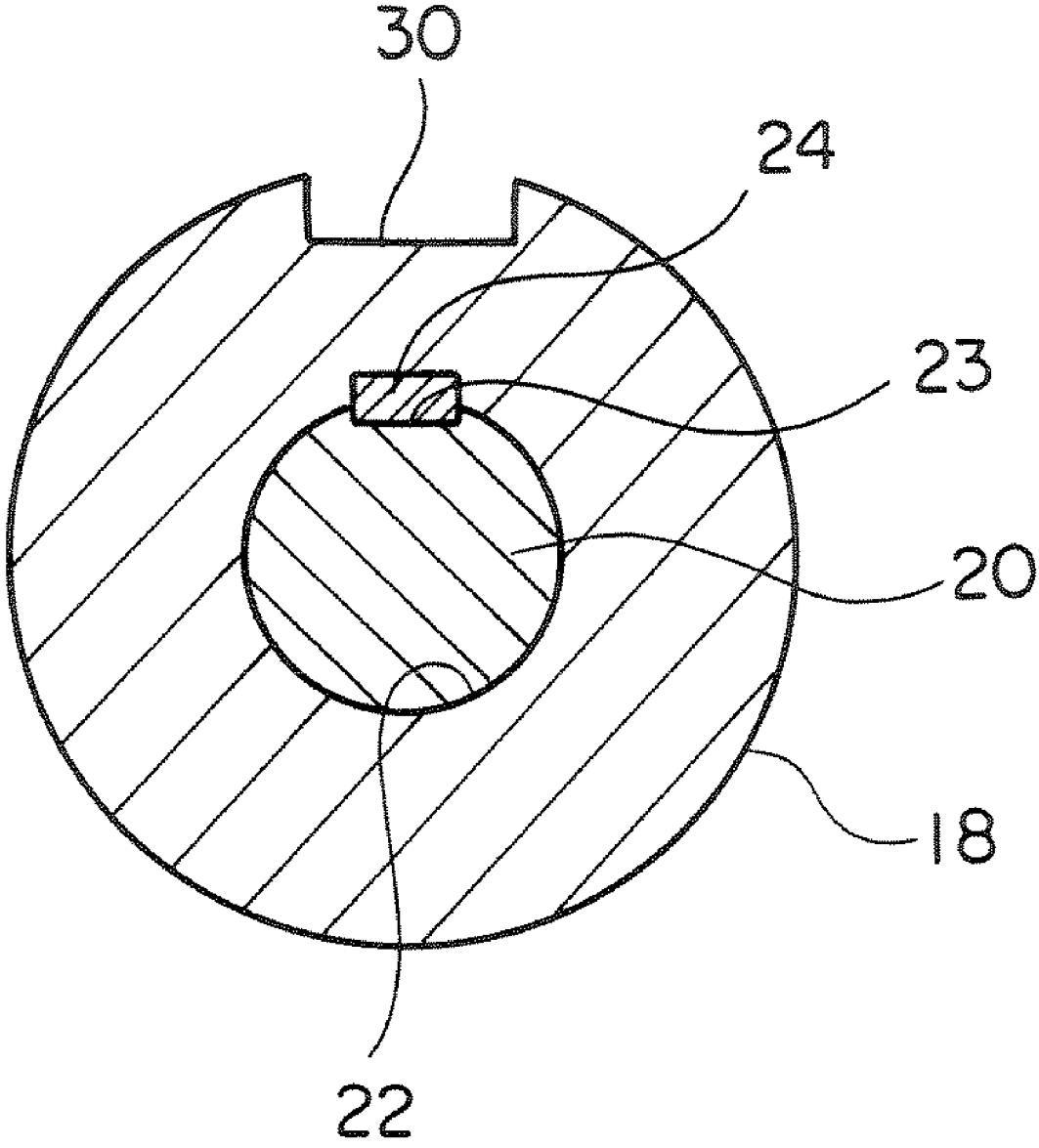
FIG. 3 is a cross-sectional view taken along the line III-III of FIG. 2.

FIG. 2 is a cross-sectional view showing an essential part of the motor shaft device 14 of FIG. 1. FIG. 3 is a cross-sectional view taken along the line III-III of FIG. 2. In the figures, the motor shaft device 14 has a joint shaft 17 fixed to the end of the motor shaft 11, and a boss 18 provided on the joint shaft 17 so as to be rotatable together with the joint shaft 17. The boss 18 is a handle fit/removal member.

The joint shaft 17 is disposed coaxially with the motor shaft 11. The joint shaft 17 can rotate integrally with the motor shaft 11. The joint shaft 17 has an insertion portion 19 in which the end of the motor shaft 11 is inserted, and a shaft body portion 20 extending from the insertion portion 19 along an axis of the motor shaft 11. In this example, the joint shaft 17 is fixed to the motor shaft 11 by means of a spring pin 21 passed through the insertion portion 19. The shaft body portion 20 is equal in axial diameter to the motor shaft 11.

The boss 18 has an outer diameter that is larger than the axial diameter of the motor shaft 11 and the shaft body portion 20. A through-hole 22 is provided through a central portion of the boss 18. The through-hole 22 has an inner diameter that is substantially equal to the axial diameter of the shaft body portion 20. The shaft body portion 20 is passed through the through-hole 22, so the boss 18 is thereby provided on the joint shaft 17. The through-hole 22 and the shaft body portion 20 are preferably engaged with each other through transition fitting, loose fitting, or the like. A key groove 23 extending along an axis of the joint shaft 17 is provided between the through-hole 22 and the shaft body portion 20. A key 24 for preventing the boss 18 from rotating with respect to the shaft body portion 20 is inserted in the key groove 23. That is, the boss 18 is fixed to the motor shaft 11 via the joint shaft 17 in a rotational direction of the motor shaft 11. A falloff preventing nut 25 for preventing the boss 18 from falling off from the shaft body portion 20 is screwed on a tip of the shaft body portion 20.

A manually operated handle 26 for manually rotating the motor shaft 11 can be removably fitted on the boss 18. The manually operated handle 26 has a cylindrical fit/removal portion 28 having a projection portion 27 on an inner peripheral face of the cylindrical fit/removal portion 28 to be removably fitted on the boss 18, and a grip portion 29 extending radially outward from the fit/removal portion 28. A groove portion 30 as a rotation preventing portion, which is engaged with the projection portion 27 to prevent the manually operated handle 26 from rotating with respect to the boss 18 in the rotational direction of the motor shaft 11 when the fit/removal portion 28 is fitted on the boss 18, is provided in an outer peripheral portion of the boss 18. That is, the groove portion 30, which is provided in a predetermined section of the boss 18 regardless of the axial diameter of the motor shaft 11 and the shaft body portion 20, is engaged with the manually operated handle 26. In this example, the groove portion 30 is provided in the boss 18 such that the distance from the groove portion 30 to the axis of the motor shaft 11 becomes larger than distances from respective outer peripheral faces of the motor shaft 11 and the shaft body portion 20 to the axis of the motor shaft 11.

An encoder 32 for measuring the rotational speed, the rotational position, and the like of the motor shaft 11 is provided on a section of the shaft body portion 20 between the boss 18 and the insertion portion 19. The encoder 32 has an encoder rotary portion 33 rotating integrally with the joint shaft 17, and an encoder body 34 for generating a signal corresponding to rotation of the encoder rotary portion 33.

A key groove 35 extending along an axial direction of the joint shaft 17 is provided between the encoder rotary portion 33 and the shaft body portion 20. A key 36 for preventing the encoder rotary portion 33 from rotating with respect to the shaft body portion 20 is inserted in the key groove 35. Thus, the encoder rotary portion 33 is fixed to the joint shaft 17 in a rotational direction of the joint shaft 17. Signals generated in the encoder body 34 are transmitted to a control device (not shown) for controlling operation of the elevator. The control device calculates the position and the speed of the car 2 in response to an input of the signal from the encoder 32, and controls operation of the elevator.

A support plate 38 is fixed to the motor body 31 by means of rod screws 37. Cylindrical collars 39, through which the rod screws 37 are passed, respectively, are interposed between the support plate 38 and the motor body 31. Thus, the support plate 38 is disposed apart from the motor body 31. A retaining strip 40 for retaining the encoder body 34 with respect to the support plate 38 is provided between the support plate 38 and the encoder body 34. Thus, the encoder body 34 is retained with respect to the motor body 31.

Next, operation of the hoist will be described. The motor shaft 11 is rotated through energization of the motor 12. At this moment, the boss 18 and the encoder rotary portion 33 are also rotated together with the motor shaft 11. When the motor shaft 11 is rotated, the main shaft 15 and the drive sheave 8 are rotated through transmission of power by the reduction gear body 16. Thus, the respective main ropes 10 are moved, so the car 2 and the counterweight 3 are raised/lowered within the hoistway 1.

When the car 2 has been stopped between floors due to, for example, a blackout or a breakdown, the manually operated handle 26 is used to manually move the car 2 to the nearer one of the floors.

Next, the procedure of manually moving the car 2 to the nearer one of the floors will be described. First of all, after it has been confirmed that energization of the motor 12 is stopped, the fit/removal portion 28 of the manually operated handle 26 is fitted on the boss 18. At this moment, it is ensured that the projection portion 27 is engaged with the groove portion 30. After that, the grip portion 29 is turned in the rotational direction of the motor shaft 11 to rotate the boss 18. Thus, the motor shaft 11 is rotated, so the car 2 and the counterweight 3 are moved. In this manner, the car 2 is manually moved to the nearer one of the floors.

In the hoisting machine 5 for the elevator constructed as described above, the boss 18 is fixed to the motor shaft 11, and the groove portion 30 for preventing the manually operated handle 26 from rotating with respect to the boss 18 is provided in the boss 18. Therefore, even when the car 2 has been stopped between floors due to, for example, a blackout or a breakdown, the motor shaft 11 can be manually rotated by fitting the manually operated handle 26 on the boss 18 and turning the manually operated handle 26. Thus, the car 2 can be moved to the nearer one of the floors.

The boss 18 is designed as a member separate from the motor shaft 11. Therefore, the boss 18 can be shaped in a form capable of being fixed to the motor shaft 11 and removably fitted with the manually operated handle 26 regardless of the axial diameter of the motor shaft 11. Thus, bosses suited for a plurality of different motor shafts can also be fixed to the different motor shafts, respectively, and the common manually operated handle 26 can be removably fitted on each of the bosses. That is, for a plurality of hoisting machines having different motor shafts, the common manually operated handle 26 can be used to manually move the car 2. Accordingly, the number of types of manually operated handles 26 can be reduced, and the manufacturing cost of the manually operated handles 26 can be reduced. Further, the amount of labor in selecting a manually operated handle can be lessened, and the amount of labor in moving the car 2 by means of the manually operated handle can be lessened.

The groove portion 30 is provided in the outer peripheral portion of the boss 18 to allow the manually operated handle 26 to be engaged with the groove portion 30. Therefore, the manually operated handle 26 can be easily prevented from rotating with respect to the boss 18 when the manually operated handle 26 is fitted on the boss 18.

The joint shaft 17, which is rotatable integrally with the motor shaft 11, is coaxially fixed to the motor shaft 11, and the boss 18 and the encoder 32 for generating signals corresponding to rotation of the joint shaft 17 are provided on the joint shaft 17. Therefore, the axial diameter of the joint shaft 17 can be adjusted to such a value that the conventionally manufactured inexpensive encoder 32, which exhibits high versatility, can be fitted on the joint shaft 17, regardless of the axial diameter of the motor shaft 11. Accordingly, each of a plurality of motor shafts with different axial diameters can be rotated by the common manually operated handle 26, and the same type of the encoder 32 can be used for each of the motor shafts with a view to measuring rotation of each of the motor shafts. Thus, when a joint shaft is fixed to a motor shaft and an encoder is fitted on the joint shaft in a case where the motor is appropriated in the event of, for example, the renewal (repair work) of an elevator, rotation of the motor shaft can be measured by the inexpensive encoder regardless of the axial diameter of the motor shaft. Accordingly, the manufacturing cost can further be reduced.

Embodiment 2

In the foregoing example, the single groove portion 30 as the rotation preventing portion is provided in the outer peripheral portion of the boss 18. However, a pair of groove portions as a pair of rotation preventing portions, which are disposed symmetrically with respect to the axis of the motor shaft 11, may be provided in the outer peripheral portion of the boss 18.

Figure 4:
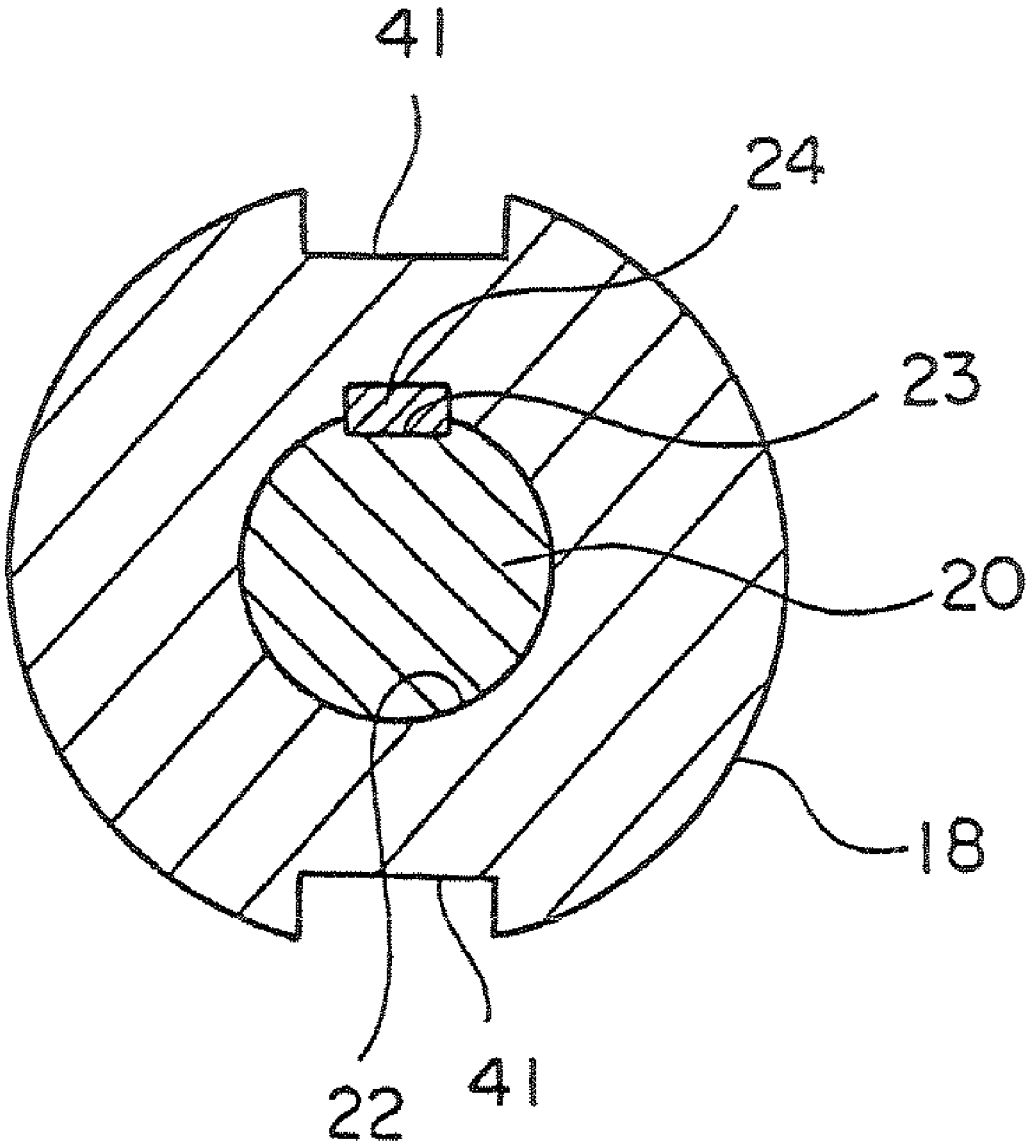
FIG. 4 is a cross-sectional view showing an essential part of a hoisting machine for an elevator according to Embodiment 2 of the present invention.

That is, FIG. 4 is a cross-sectional view showing an essential part of a hoisting machine for an elevator according to Embodiment 2 of the present invention. FIG. 4 is a cross-sectional view corresponding to FIG. 3 according to Embodiment 2 of the present invention. In this figure, a pair of groove portions (rotation preventing portions) 41, which are disposed symmetrically with respect to the axis of the motor shaft 11, are provided in the outer peripheral portion of the boss 18. The respective groove portions 41 are identical with each other in cross-sectional shape. Thus, the outer peripheral portion of the boss 18 is shaped symmetrically with respect to the axis of the motor shaft 11. The center of gravity of the boss 18 is located in a position substantially identical with that of the axis of the motor shaft 11.

A pair of projection portions, which are engaged with the groove portions 41, respectively, are provided on an inner peripheral face of the fit/removal portion 28 of the manually operated handle 26. Embodiment 2 of the present invention is identical to Embodiment 1 of the present invention in other constructional details.

In the hoisting machine constructed as described above, the pair of the groove portions 41, which are disposed symmetrically with respect to the axis of the motor shaft 11, are provided in the outer peripheral portion of the boss 18. Therefore, the outer peripheral portion of the boss 18 can be shaped symmetrically with respect to the axis of the motor shaft 11, so the amplitude of sways (vibrations) caused during rotation of the boss 18 can be reduced.

In the foregoing example, the pair of the groove portions 41 are provided in the outer peripheral portion of the boss 18. However, a plurality of pairs of groove portions 41 may be provided in the outer peripheral portion of the boss 18 as long as they are disposed symmetrically with respect to the axis of the motor shaft 11. In this case, a plurality of pairs of projection portions, which are engaged with the groove portions 41, respectively, are provided on the inner peripheral face of the fit/removal portion 28 as well.

In the foregoing embodiments of the present invention, the groove portion as the rotation preventing portions, with which the projection portion of the manually operated handle are engaged, are provided in the outer peripheral portion of the boss 18. However, groove portions may be provided in the manually operated handle, and projection portions as a rotation preventing portion, which are engaged with the groove portions of the manually operated handle, may be provided on the outer peripheral portion of the boss 18.

In the foregoing embodiments of the present invention, the boss 18 is fixed to the motor shaft 11 via the joint shaft 17. However, the boss 18 may be directly fixed to the motor shaft 11. In this case, the encoder 32 is provided on the motor shaft 11. In this manner as well, bosses on which a common manually operated handle can be removably fitted can be fixed to a plurality of different motor shafts, respectively. As a result, the number of types of manually operated handles can be reduced.

The invention claimed is:

1. An elevator, comprising:

at least one of a plurality of hoisting machines having motors having rotary shafts having different external diameters, a plurality of bosses each mounted on a respective one of said rotary shaft and each having the same external diameter, and a common manually operated handle which may be fixed to each of said bosses, wherein the common manually operated handle is adapted to manually rotate the rotary shafts when the manually operated handle is fitted on any one of said bosses.

2. A kit for a plurality of elevators each of which comprises a motor shaft, said motor shafts having at least two different outer diameters, said kit comprising:

(a) a plurality of bosses which, in use, can be removably mounted on corresponding ones of said motor shafts and (b) a manually operated handle which, during a blackout or a breakdown, can be used to rotate said motor shafts, wherein (c) the inner diameter of each of said bosses is sized and shaped to mount on the outer diameter of a corresponding one of said motor shafts;

(d) the outer diameter of all of said bosses is the same; and (e) said manually operated handle is configured to rotatably engage any one of said bosses, (f) whereby a single manually operated handle can be used to manually rotate the motor shaft of any one of said plurality of elevators.

3. A kit as recited in claim 2 wherein, in use, each of said bosses is prevented from rotating relative to the corresponding one of said motor shafts by means of a key and keyway.

4. A kit as recited in claim 3 wherein, in use, each of said bosses is prevented from translation relative to the corresponding one of said motor shafts by means of a falloff preventing nut.

* * * * *